United States Patent [19]

Iddan

[11] Patent Number: 5,064,285

[45] Date of Patent: Nov. 12, 1991

[54] POSITION-CONTROLLED ELECTROMAGNETIC ASSEMBLY

[75] Inventor: Gavriel J. Iddan, Haifa, Israel

[73] Assignee: State of Israel, Ministry of Defense, Haifa, Israel

[21] Appl. No.: 528,394

[22] Filed: May 25, 1990

[51] Int. Cl.[5] ..... G01B 11/26

[52] U.S. Cl. ..... 356/141; 89/41.06

[58] Field of Search ..... 356/141, 152; 89/37.01, 89/41.01, 41.06; 350/DIG. 3; 248/179, 181; 250/453.1; 244/3.13, 3.16

[56] References Cited

U.S. PATENT DOCUMENTS

| | | | |
|---|---|---|---|
| 3,438,270 | 4/1969 | Binder et al. | 74/5.47 |
| 3,982,714 | 9/1976 | Kuhn | 244/3.16 |
| 4,036,453 | 7/1977 | Evans et al. | 244/3.16 |
| 4,600,166 | 7/1986 | Califano et al. | 244/3.16 |

FOREIGN PATENT DOCUMENTS 1442773 7/1976 United Kingdom .

*Primary Examiner*—Linda J. Wallace

*Attorney, Agent, or Firm*—Benjamin J. Barish

[57] ABSTRACT

An electromagnetic assembly includes a gimbal pivotally mounting an electromagnetic device to a housing, a magnetic body secured to the electromagnetic device producing a magnetic field coaxial with a first orthogonal axis; coils secured to the housing so as to be magnetically coupled to the magnetic body and oriented such that current through them produces a magnetic field along second and third orthogonal axes, respectively; and a current source for applying electrical current to the coils such that the magnetic fields produced thereby, interacting with the magnetic fields produced by the magnetic body, produce a torque controlling the position of the electromagnetic device with respect to the second and third orthogonal axes.

13 Claims, 4 Drawing Sheets

POSITION-CONTROLLED ELECTROMAGNETIC ASSEMBLY

BACKGROUND OF THE INVENTION

The present invention relates to position-controlled electromagnetic assemblies, and particularly to systems for stabilizing the position of such assemblies.

One application of space-stabilized electromagnetic assemblies is in missile seekers carried by missiles and serving the functions of detecting the target, locking the seeker on it, and directing the missile to the target. Such assemblies include various types of sensors, such as TV, infrared, laser and radar devices. A typical optic seeker includes a telescope, a detector, a gimbal mounting for space stabilization or other position control with respect to elevation and azimuth, and a signal processor.

Various arrangements are known for initially stabilizing the sensors. One known type of stabilization includes a free gyro which spins a mass around the telescope to stabilize the line of sight. A second known type of stabilization includes a platform mounting small measurement gyros which produce correction signals for correcting any deviation of the optic device from its initial preset orientation.

In one known platform stabilization arrangement, small correction torquers are mounted on the gimbals themselves for each degree of freedom at the end of the gimbal opposite to the sensor. In a second known platform arrangement, the torquers are mounted outside of the gimbals and are connected to them by push-rods. Generally, these known platform arrangements for controlling the position of the seeker, or stabilizing it, increase the size, complexity and weight of the assembly.

OBJECTS AND SUMMARY OF THE INVENTION

An object of the present invention is to provide a position-controlled or space-stablilized electromagnetic assembly of a relatively small, simple and lightweight construction as compared to the above-described known systems. Another object of the invention is to provide an electromagnetic assembly which can provide, in addition to position control or space stabilization, also angular measurements and angular-rate measurements of the electromagnetic device in the assembly.

The invention provides an electromagnetic assembly comprising a housing; an electromagnetic device having at least one end enclosed by the housing and having its longitudinal axis oriented along a first orthogonal axis with respect to the housing; and gimbal means pivotally mounting the electromagnetic device to the housing for pivotal movement about second and third orthogonal axes with respect to the housing; characterized in that the gimbal means pivotally mounts the electromagnetic device to the housing permitting only pivotal movement of the electromagnetic device about the second and third orthogonal axes with respect to the housing, and preventing rotary movement of the electromagnetic device about the first longitudinal axis (e.g., Z-axis); and in that the assembly further includes: a magnetic body secured to the electromagnetic device at the end thereof enclosed by the housing and producing a magnetic field coaxial with the first orthogonal axis; first coil means secured to the housing so as to be magnetically coupled to the magnetic body and oriented such that current through the first coil means produces a magnetic field along the second orthogonal axis; second coil means secured to the housing so as to be magnetically coupled to the magnetic body and oriented such that current through the second coil means produces a magnetic field along the third orthogonal axis; and a current source for applying electrical current to the first and second coil means such that the magnetic fields produced thereby, interacting with the magnetic field produced by said magnetic body, produce a torque controlling the position of the electromagnetic device with respect to the second and third orthogonal axes.

In the preferred embodiment of the invention described below, the first and second coil means each comprises a pair of coils secured to the housing axially spaced from the magnetic body and on opposite sides of the first orthogonal axis, and the current source applies current to the pair of coils of each of the coil means in proportion to the deviation of the electromagnetic device with respect to the second and third orthogonal axes to thereby stabilize the device with respect to such axes.

According to further features in the described preferred embodiment, the current source applies the current to the coil means in pulses having pulse widths corresponding to the torque to be applied to the electromagnetic device; also, the pulses are separated by zero-current intervals, the system further including means for measuring the back EMF generated by the coil means during the zero-current intervals for providing a measurement of the angular rate of change of the electromagnetic device with respect to the second and third orthogonal axes.

According to another feature in the described preferred embodiment, the system further includes means for applying a current to the two pairs of coils at a higher frequency than that applied to the coils for producing the torque controlling the position of the electromagnetic device, and means for measuring the voltage difference between each pair of coils to thereby provide a measurement of the angular position of the electromagnetic device with respect to the second and third orthogonal axes. This higher frequency should be much higher than the maximum frequency of the torquing signal in order to discriminate between the torquing signal and the angular measurement signal, but not so high as to produce significant radiation. For example, the torquing signal may be at a frequency of less than 100 Hz, e.g., 80 Hz, in order to have a short response time; and the angle-measuring signal may be in the order of 4 KHz.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
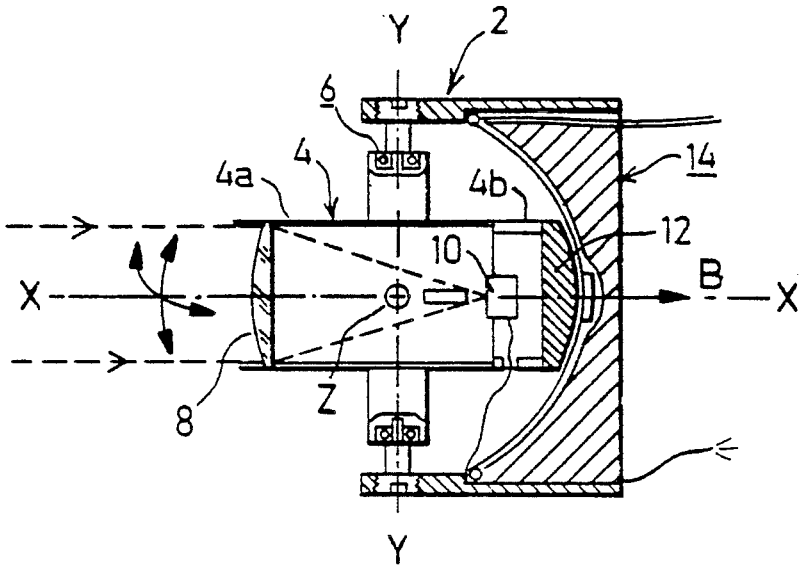
FIG. 1 illustrates one form of position-controlled or space-stabilized electromagnetic assembly constructed in accordance with the present invention.

The electromagnetic assembly illustrated in FIG. 1 is an optic assembly for use as a missile seeker, which assembly is to be carried by the missile and is to be used for detecting the target, locking the missile on it, and directing the missile to the target. The assembly includes a housing 2, and an optic device, generally designated 4, pivotally mounted by a gimbal 6 providing two degrees of movement to the optic device with respect to the housing 2. That is, the gimbal 6 pivotally mounts the optic device 4 to the housing 2 permitting pivotal movement of the optic device only about the X-axis and the Y-axis with respect to the housing, and prevents rotary movement of the electromagnetic device about the Z-axis. Thus, the optic or longitudinal axis of optic device 4 is along a first orthogonal axis X with respect to housing 2. The optic device is pivotally mounted by gimbal 6 for pivotal movement about a second orthogonal axis Y (azimuth), and about a third orthogonal axis Z (elevation), with respect to the housing 2.

The outer end 4*a* of optic device 4 projects through the open end of housing 2, whereas the inner end 4*b* of the optic device is enclosed within the housing. The projecting end 4*a* carries a telescope, schematically indicated by lens 8; and its inner end 4*b* carries an optic sensor 10 on which are focussed the optic rays from telescope 8.

The inner end 4*b* of optic device 4 further carries a magnetic body 12 producing a magnetic field, indicated by arrow "B", which is coaxial with the optic axis X of the optic device. Housing 2, enclosing the inner end 4*b* of the optic device 4, carries a coil assembly, generally designated 14, which cooperates with magnetic body 12 to perform the following three functions: (1) produce torque in order to control the position of optic device 4 with respect to the two orthogonal axes Y and Z; (2) measure the angular-rate of change of the optic device 4 with resect to the housing 2; and (3) measure the angle of the optic device 4 with respect to the housing 2.

Figure 2:
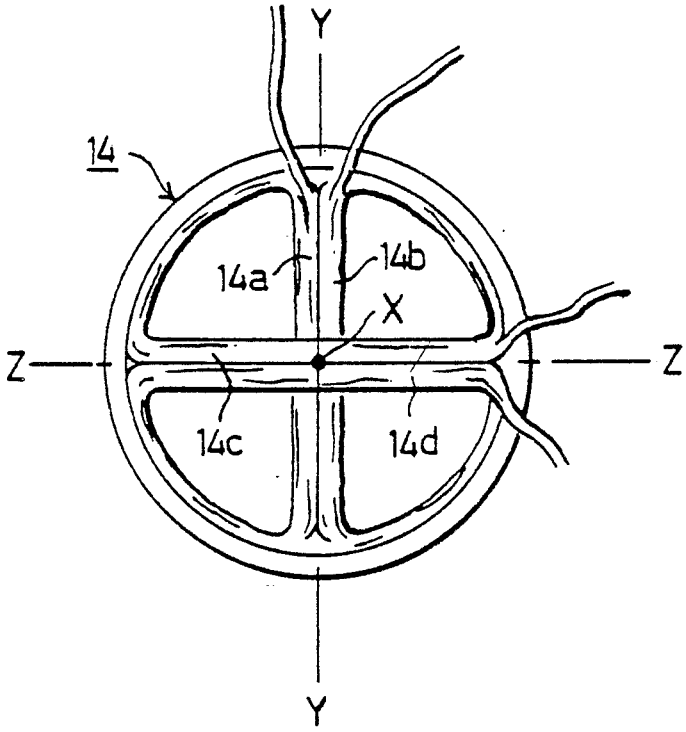
FIG. 2 is a front view of the coil assembly in the electromagnetic assembly of FIG. 1.

FIG. 2 more particularly illustrates the construction of coil assembly 14 fixed within housing 2. Thus, as shown in FIG. 2, coil assembly 14 includes four separate D-shaped coils 14*a*–14*d* embedded within a plastic body such that one pair of coils, namely coils 14*a*, 14*b*, are on opposite sides of the optic axis X of the optic device 4 along axis Y, and another pair of 14*c*, 14*d* are on opposite sides of the optic axis X along axis Z.

Figure 3:
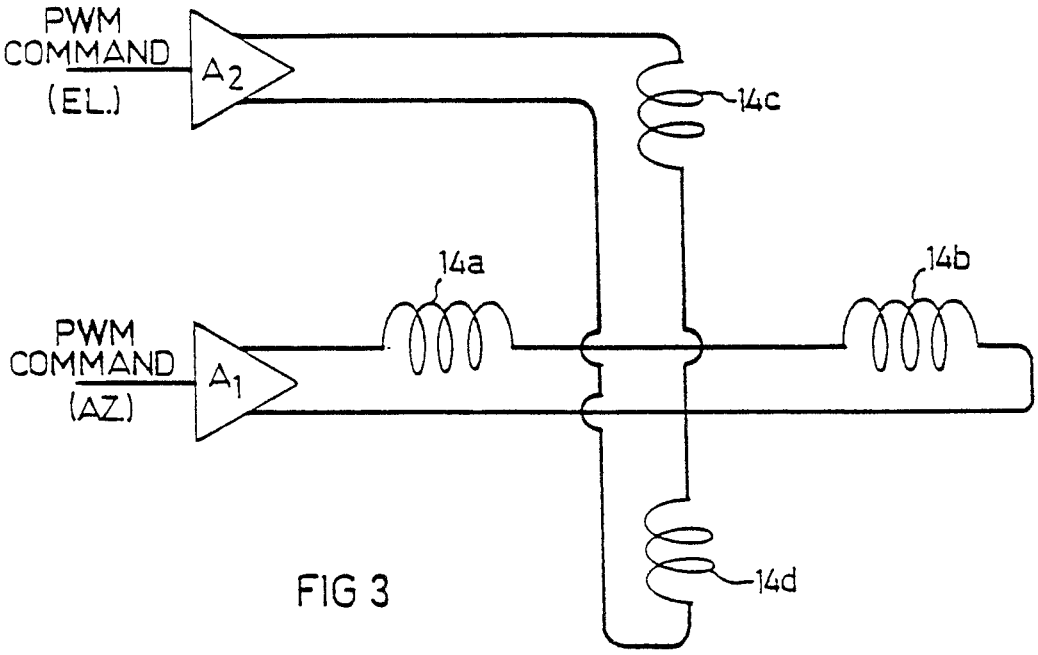
FIG. 3 is a circuit diagram illustrating the manner of applying the torque-producing signals to the assembly of FIG. 1 in order to control its position.

FIG. 3 illustrates the electrical circuit connections to coils 14*a*, 14*b* and coils 14*c*, 14*d*. Thus, current is supplied to coils 14*a*, 14*b* in series via current amplifier $A_1$, and current is supplied to coils 14*c*, 14*d* in series via current amplifier $A_2$. It will be seen that, according to the magnitude and direction of current supplied by the current amplifiers $A_1$ and $A_2$, coils 14*a*–14*d* will produce magnetic fields which interact with the magnetic field B of the magnetic body 12, to produce a torque controlling the position of the optic device 4 with respect to the azimuth axis Y and the elevation axis Z.

Figure 5:
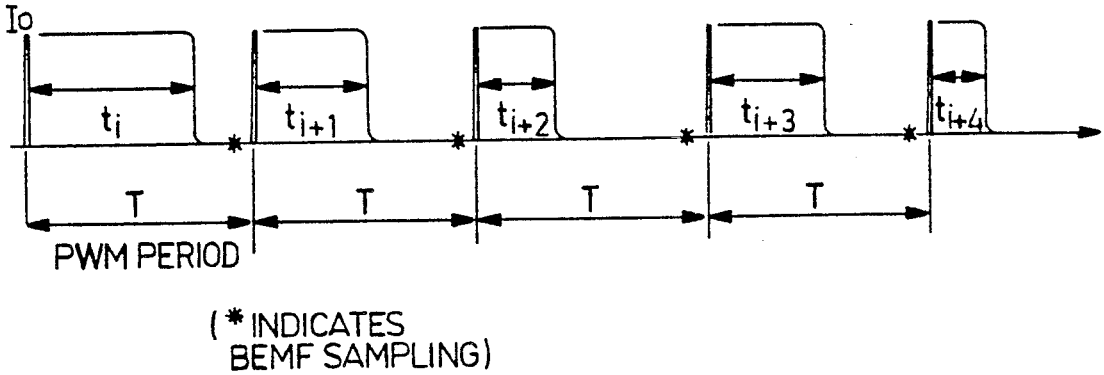
FIG. 5 is a timing diagram illustrating the timing for producing the torque signals and for making the angular-rate measurements in the circuits of FIGS. 3 and 4, respectively.

Both current amplifiers $A_1$, $A_2$ are supplied with pulses having pulse widths corresponding to the torque to be applied to optic device 4. This is shown in the waveforms illustrated in FIG. 5, wherein it will be seen that the command signals applied to the current amplifiers $A_1$ and $A_2$ are in the form of pulses $t_i$, $t_{i+1}$, $t_{i+2}$ - - - , each such pulse having a pulse width corresponding to the torque to be produced. As also shown in FIG. 5, such pulses are applied in fixed time periods T, which time periods should be sufficiently long so that each such pulse is separated by zero-current intervals. These zero-current intervals are used for measuring the back EMF induced by the coils 4*a*–14*d*, to provide a measurement of the angular rate of change of the optic device 4 with respect to the azimuth axis Y and the elevation axis Z of housing 2, a will be described more particularly below.

Figure 4:
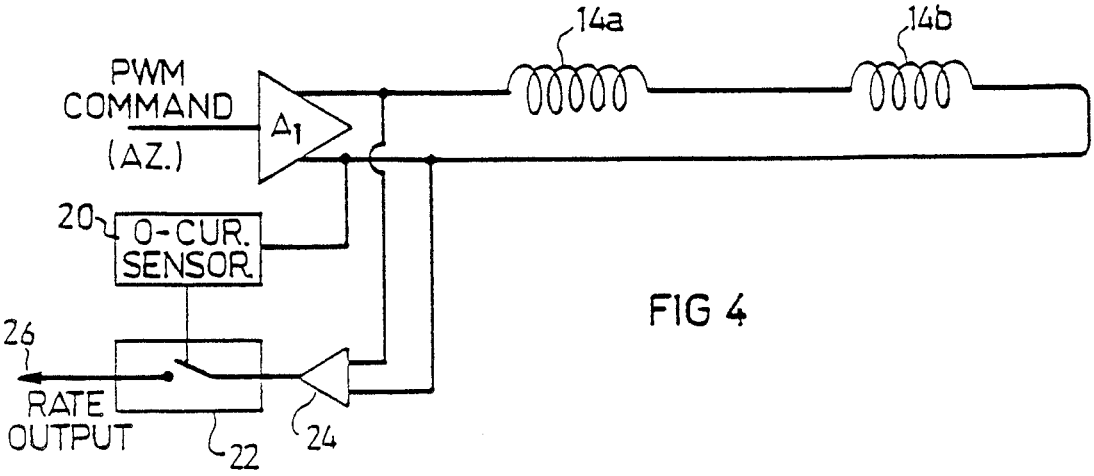
FIG. 4 is a circuit diagram illustrating the manner of making the angular rate measurements in the assembly of FIG. 1.

FIG. 4 illustrates a circuit for sampling the back EMF during the zero-current intervals of the torquing pulses applied by current amplifier $A_1$ to the two coils 14*a*, 14*b*. It will be appreciated that a similar circuit is provided with respect to the pulses applied by current amplifier $A_2$ to the coils 14*c*, 14*d*.

Thus, the output of current amplifier $A_1$ is sensed by a zero-current sensor 20 which controls a switch 22. This circuit also includes a voltage differential-amplifier 24 connected across the two coils 14*a*, 14*b* in series, so as to sense the back EMF generated by the two coils. The output of voltage differential amplifier 24 is connected via the back EMF switch 22 to an output terminal 26, such that the signal appearing on the output terminal 26 represents the back EMF generated by coils 14*a*, 14*b* during the zero-current intervals. It will be appreciated that this signal appearing on output terminal 26 is a measurement of the angular rate of change of optic device 4, including its optic sensor 10 and its magnetic body 12, with respect to the azimuth axis Y.

It will also be appreciated that a similar circuit, provided for coils 14*b*, 14*c* supplied by current from current amplifier $A_2$, will produce a measurement of the angular rate of change of housing 2, optic device 4 and magnetic body 12 with respect to the attitude axis Z.

Figure 6:
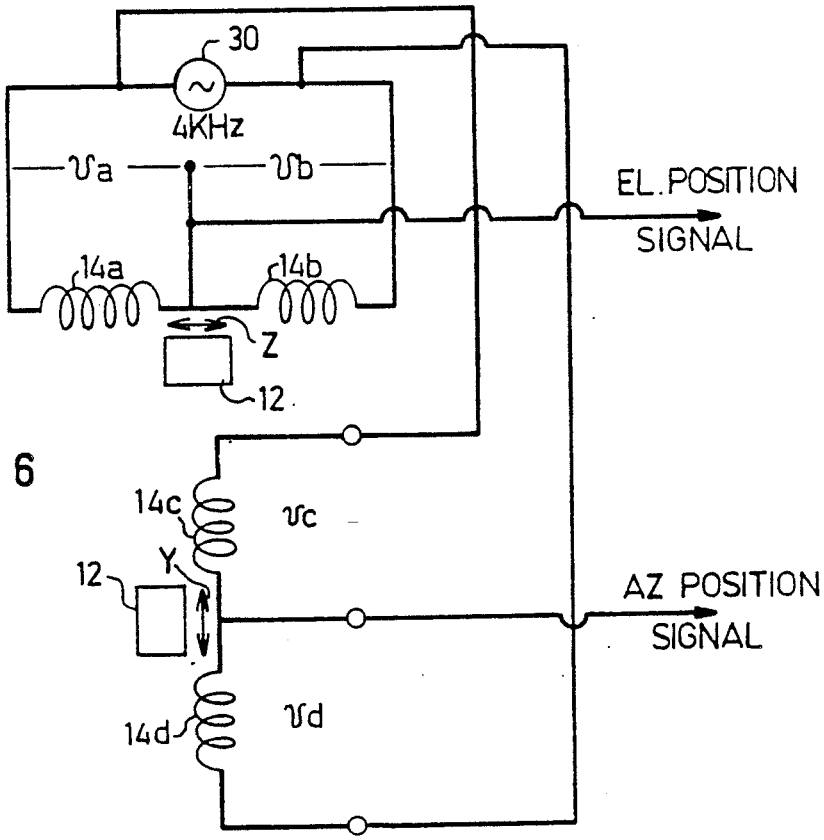
FIG. 6 is a circuit diagram illustrating the manner of making the angular measurements in the assembly of FIG. 1.

FIG. 6 illustrates the circuit for measuring the angle of optic device 4, including its optic sensor 10 and its magnetic body 12, with respect to both the azimuth axis Y and the attitude axis Z. Thus, the magnetic body 12 acts as a coupling core between the two pairs of coils 14*a*, 14*b* and 14*c*, 14*d*. A current of high frequency is applied from source 30 to both pairs of coils 14*a*, 14*b* and 14*c*, 14*d*, and the voltage difference is detected between the coils of each pair. This voltage difference is proportional to the position of magnetic body 12 with respect to the two coils of each pair.

Thus, when magnetic body 12 is exactly between the two coils 14*a*, 14*b* along the azimuth axis Y, voltage $v_a$ will be exactly equal to voltage $v_b$, so that $v_a/v_b=1$. When the magnetic body 12 is not exactly midway between the two coils 14*a*, 14*b*, $v_a/v_b$ will not be equal to 1, but to a value depending on the specific position of the two coils 14*a*, 14*b* with respect to the magnetic body 12, thereby providing a measurement of the angular position of the magnetic body, and also of optic device 4, with respect to the azimuth axis Y.

In a similar manner, the voltages generated across coils 14*c*, 14*d*, namely $v_c/v_d$, will provide a measurement of the position of magnetic body 12, and thereby of optic device 4, with respect to the attitude axis Z.

The frequency of current source 30 should be much higher than the frequency of the torque current supplied to amplifiers $A_1$, $A_2$ in the torque-producing circuit illustrated in FIG. 3 in order to enable discrimination between the torquing signal and the angular measurement signal. Source 30, however, should not be so high as to produce significant radiation. For purposes of example, the torquing signal applied to amplifier $A_1$, $A_2$ in FIG. 3 should be less than 100 Hz, e.g., preferably about 80 Hz, in order to have a short response time, whereas the frequency of source 30 providing the angle-measuring signals may be in the order of 4 KHz.

Figure 7:
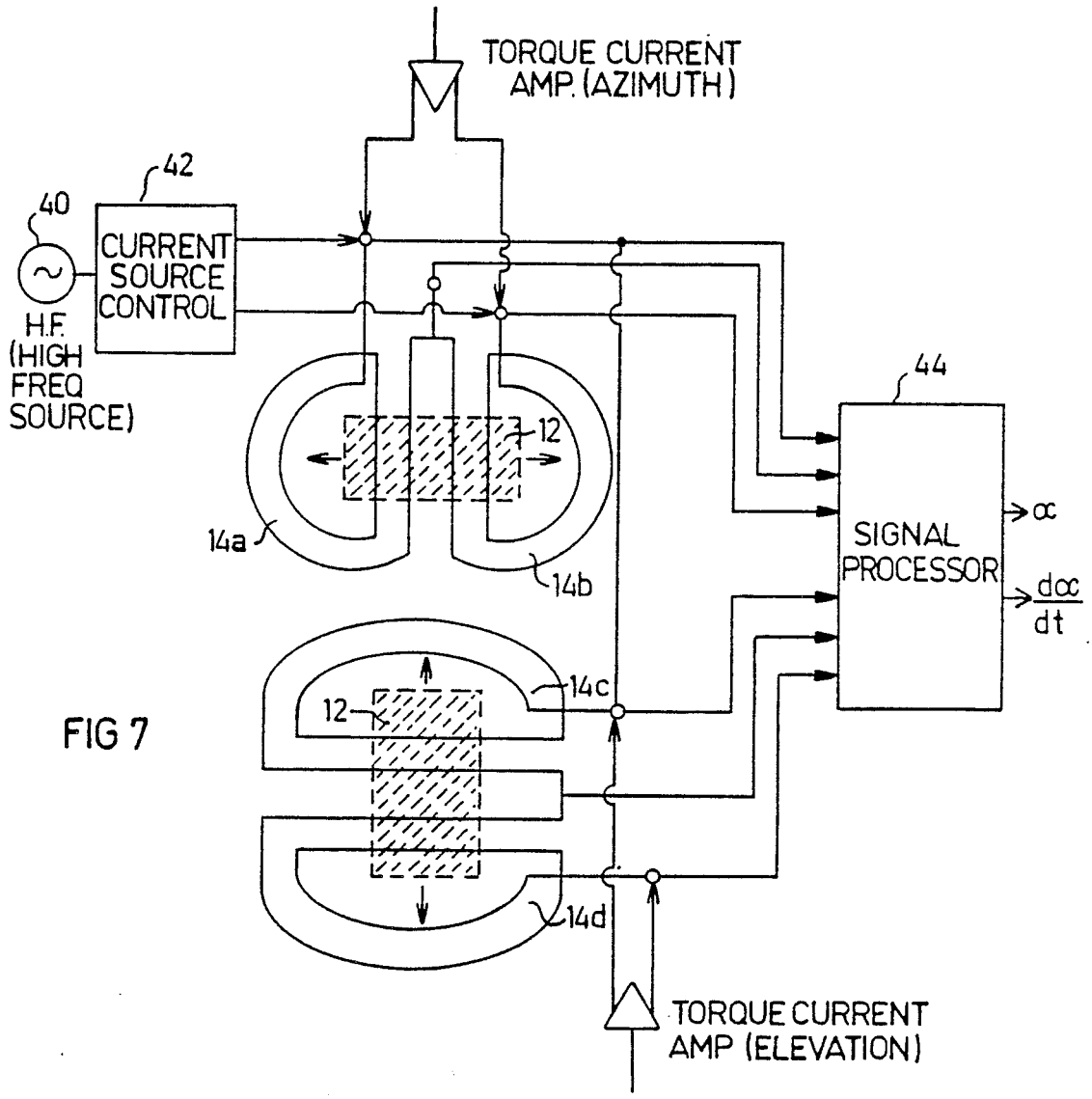
FIG. 7 is a circuit diagram illustrating the overall system for producing the torque and for making the angular and angular-rate measurements in the illustrated system.

FIG. 7 schematically illustrates an overall circuit that may be used with the optic assembly shown in FIGS. 1–6 for performing the three functions described above, namely: (1) controlling the position of optic device 4 and magnetic body 12; (2) producing an angular-rate signal providing a measurement of the angular rate of change of optic device 4; and (3) producing an angular signal providing a measurement of the position of optic device 4 with respect to housing 2.

Thus, as schematically shown in FIG. 7, the system includes a source of current, generally designated 40, controlled by circuit 42 to provide the proper frequency. Control circuit 42 also includes the previously-described current amplifiers $A_1$, $A_2$ producing the torque current at a frequency of less than 100 Hz, and also producing the angular-rate measuring current at a frequency of 4 KHz to the two pairs of coils 14*a*, 14*b* and 14*c*, 14*d*. The outputs of these coils are fed to a signal processor, generally designated 44, to produce a first output signal "$\alpha$" providing a measurement of the angular position of the optic device 4 with respect to the coils 14*a*–14*d* along both axes Y and Z, and a second signal "$d\alpha/dt$" providing a measurement of the rate-of-change of the angular position of housing 2 with respect to both of these axes, in the manner described earlier with respect to FIGS. 1–6.

While the invention has been described with respect to one preferred embodiment, it will be appreciated that many variations, modifications and other applications of the invention may be made.

What is claimed is:

1. An electromagnetic assembly, comprising: a housing; an electromagnetic device having at least one end enclosed by said housing and having its longitudinal axis oriented along a first orthogonal axis with respect to said housing; mounting means pivotally mounting said electromagnetic device to said housing permitting pivotal movement of said electromagnetic device about second and third orthogonal axes with respect to the housing, and preventing rotary movement of said electromagnetic device about said first longitudinal axis; a magnetic body secured to said electromagnetic device at the end thereof enclosed by said housing and producing a magnetic field coaxial with said first orthogonal axis; first coil means secured to said housing so as to be magnetically coupled to said magnetic body and oriented such that current through said first coil means produces a magnetic field along said second orthogonal axis; second coil means secured to said housing so as to be magnetically coupled to said magnetic body and oriented such that current through the second coil means produces a magnetic field along said third orthogonal axis; and a current source for applying electrical current to said first and second coil means such that the magnetic fields produced thereby, interacting with the magnetic field produced by said magnetic body, produce a torque controlling the position of said electromagnetic device with respect to said second and third orthogonal axes; said current source applying the current to said first and second coil means in pulses having pulse widths corresponding to the torque to be applied to the electromagnetic device.

2. The assembly according to claim 1, wherein said first and second coil means are secured to said housing axially spaced from said magnetic body and each comprises a pair of coils on opposite sides of said first orthogonal axis, and said current source applies current to the pair of coils of each of said coil means in proportion to the deviation of said electromagnetic device with respect to said second and third orthogonal axes to thereby stabilize the device with respect to said axes.

3. The assembly according to claim 2, wherein said current source applies the current to said coil means at a frequency of less than 100 Hz.

4. The assembly according to claim 2, wherein said current source applies the current to said coil means in pulses having pulse widths corresponding to the torque to be applied to the electromagnetic device.

5. The assembly according to claim 4, wherein said pulses are separated by zero-current intervals, said assembly further including means for measuring the back EMF generated by said coil means during said zero-current intervals for providing a measurement of the angular rate of change of the electromagnetic device with respect to said second and third orthogonal axes.

6. An electromagnetic assembly, comprising: a housing; an electromagnetic device having at least one end enclosed by said housing and having its longitudinal axis oriented along a first orthogonal axis with respect to said housing; mounting means pivotally mounting said electromagnetic device to said housing permitting pivotal movement of said electromagnetic device about second and third orthogonal axes with respect to the housing, and preventing rotary movement of said electromagnetic device about said first longitudinal axis; a magnetic body secured to said electromagnetic device at the end thereof enclosed by said housing and producing a magnetic field coaxial with said first orthogonal axis; first coil means secured to said housing so as to be magnetically coupled to said magnetic body and oriented such that current through said first coil means produces a magnetic field along said second orthogonal axis; second coil means secured to said housing so as to be magnetically coupled to said magnetic body and oriented such that current through the second coil means produces a magnetic field along said third orthogonal axis; and a current source for applying electrical current to said first and second coil means such that the magnetic fields produced thereby, interacting with the magnetic field produced by said magnetic body, produce a torque controlling the position of said electromagnetic device with respect to said second and third orthogonal axes; said assembly further including means for applying a current to said two pairs of coils at a higher frequency than that applied to the coils for producing the torque controlling the position of the electromagnetic device, and means for measuring the voltage difference between each pair of coils to thereby provide a measurement of the angular position of the electromagnetic device with respect to said second and third orthogonal axes.

7. The assembly according to claim 6, wherein said higher frequency is in the order of 4 KHz.

8. The assembly according to claim 1, wherein said electromagnetic device is an optic device and includes an optic sensor having an optic axis oriented along said first orthogonal axis with respect to said housing.

9. An electromagnetic assembly, comprising:

a housing;

an optic device having at least one end enclosed by said housing and including an optic sensor having an optic axis oriented along a first orthogonal axis with respect to said housing;

a gimbal means pivotally mounting said optic device to said housing permitting only pivotal movement of said electromagnetic device about second and third orthogonal axes with respect to the housing, and preventing rotary movement of said electromagnetic device about said first longitudinal axis;

a magnetic body secured to said optic device and producing a magnetic field coaxial with said first orthogonal axis;

first coil means secured to said housing axially spaced from said magnetic body so as to be magnetically coupled to said magnetic body and oriented such that current through said first coil means produces a magnetic field along said second orthogonal axis;

second coil means secured to said housing also axially spaced from said magnetic body so as to be magnetically coupled to said magnetic body and oriented such that current through the second coil means produces a magnetic field along said third orthogonal axis;

and a current source for applying electrical current to said first and second coil means such that the magnetic fields produced thereby, interacting with the magnetic field produced by said magnetic body, produce a torque controlling the position of said optic device with respect to said second and third orthogonal axes;

said current source applying the current to said first and second coil means in pulses having pulse widths corresponding to the torque to be applied to the electromagnetic device.

10. The assembly according to claim 9, wherein said first and second coil means each comprises a pair of coils on opposite sides of said first orthogonal axis, and said current source applies current to the pair of coils of each of said coil means in proportion to the deviation of said optic device with respect to said second and third orthogonal axes to thereby stabilize the device with respect to said axes.

11. The assembly according to claim 9, wherein said current source applies the current to said coil means in pulses having pulse widths corresponding to the torque to be applied to the optic device.

12. The assembly according to claim 11, wherein said pulses are separated by zero-current intervals, said assembly further including means for measuring the back EMF generated by said coil means during said zero-current intervals for providing a measurement of the angular rate of change of the optic device with respect to said second and third orthogonal axes.

13. The assembly according to claim 11, wherein said assembly further includes means for applying a current to said two pairs of coils at a higher frequency than that applied to the coils for producing the torque controlling the position of the optic device, and means for measuring the voltage difference between each pair of coils to thereby provide a measurement of the angular position of the optic device with respect to said second and third orthogonal axes.

* * * * *